US006130509A

United States Patent [19]

Kates et al.

[11] Patent Number: 6,130,509

[45] Date of Patent: Oct. 10, 2000

[54] BALANCED FEEDBACK SYSTEM FOR FLOATING COLD CATHODE FLUORESCENT LAMPS

[75] Inventors: Barry K. Kates, Austin; John Cummings, Round Rock, both of Tex.

[73] Assignee: Dell Computer Corporation, Round Rock, Tex.

[21] Appl. No.: 09/236,138

[22] Filed: Jan. 22, 1999

[51] Int. Cl.[7] ..... H05B 37/02

[52] U.S. Cl. ..... 315/224; 315/307; 315/DIG. 7

[58] Field of Search ..... 315/224, 225, 315/226, 200 R, 207, 209 R, 276, 278, 283, 291, 307, DIG. 2, DIG. 4, DIG. 5, DIG. 7; 323/305, 358

[56] References Cited

U.S. PATENT DOCUMENTS

| | | | |
|---|---|---|---|
| 4,677,534 | 6/1987 | Okochi | 323/267 |
| 5,256,939 | 10/1993 | Nilssen | 315/DIG. 5 |
| 5,408,162 | 4/1995 | Williams | 315/DIG. 7 |
| 5,430,641 | 7/1995 | Kates | 363/133 |
| 5,652,479 | 7/1997 | LoCascio et al. | 315/225 |
| 5,731,694 | 3/1998 | Wilcox et al. | 323/287 |
| 5,747,942 | 5/1998 | Ranganath | 315/291 |
| 5,754,012 | 5/1998 | LoCascio et al. | 315/307 |
| 5,767,630 | 6/1998 | Williams | 315/282 |
| 5,815,384 | 9/1998 | Hammond et al. | 363/26 |
| 5,880,946 | 3/1999 | Biegel | 363/75 |

*Primary Examiner*—Don Wong
*Assistant Examiner*—Thuy Vinh Tran
*Attorney, Agent, or Firm*—Skjerven Morrill MacPherson LLP; Stephen A. Terrile; Mary Jo Bertani

[57] ABSTRACT

An apparatus and method are provided for driving a cold cathode fluorescent lamp in a floating configuration with an inverter circuit having a transformer with a primary winding and two secondary windings. At least one sense resistor is coupled in series between terminals of the secondary windings. The other terminal of each secondary winding is coupled to a respective end of the fluorescent lamp. A rectifier is coupled to the secondary portion of the transformer to receive a signal indicative of the current in at least one end of the fluorescent lamp and generates a feedback signal. A control and drive circuit generates drive signals based on the feedback signal to control the current in the fluorescent lamp and outputs the drive signals to the primary transformer winding.

22 Claims, 6 Drawing Sheets

BALANCED FEEDBACK SYSTEM FOR FLOATING COLD CATHODE FLUORESCENT LAMPS

BACKGROUND OF THE INVENTION

1. Field of the Invention

This invention relates to fluorescent lamp power supplies, and more particularly, to an inverter circuit for driving a cold cathode fluorescent lamp in a floating configuration.

2. Description of the Related Art

The use of fluorescent lamps continues to increase as systems requiring an efficient and broad-area source of visible light become essential for various consumer electronic devices. For example, the use of portable computers such as laptop and notebook computers is rapidly increasing. In portable computers, fluorescent lamps are used to back-light or side-light liquid crystal displays to improve the contrast or brightness of the display. Other examples of the use of fluorescent lamps includes illuminating automobile dashboards and commercial signage.

Fluorescent lamps are used in various applications due to their energy efficiency and their ability to diffuse light over a broad area compared to other lighting sources. The increased efficiency of fluorescent lamps becomes particularly important in battery-driven devices, where longer battery life translates to being able to use the device for a longer period of time without recharging the battery or having to find an alternate power source. The relative efficiency of fluorescent lamps notwithstanding, in portable equipment, such as a laptop computer, the back-light can account for as much as 40% of the total equipment power drain. In applications where portability is important, further advantage is gained where smaller and more lightweight battery packs may be used due to the energy efficiency of the device.

In many portable device applications, however, extended battery life is often limited by energy losses, such as those due to parasitic energy paths. For example, fluorescent lamps are traditionally driven by signals input to one end of the lamp, where one end of the lamp is coupled to a sinusoidal drive signal and the other end of the lamp is held at essentially ground potential. The parasitic energy loss is relatively high due to the high amplitude required to drive the lamp to fully illuminate it. This energy loss translates into decreased battery life or heavier batteries, or both.

In notebook computers, an inverter circuit is typically used to convert unregulated DC voltage to regulated AC current to provide power to drive, also referred to as illuminating, the fluorescent lamp. The inverter circuit is typically mounted on one of the sides of the display panel, thereby adding width to the panel assembly. In the past, the keyboard in a laptop computer was usually wider than the display, however, as display size increases beyond the size of the keyboard in more modern laptop computers, it is desirable to move the inverter circuit from the side of the display to another location to avoid increasing the width of the housing.

In view of the foregoing, it is therefore desirable to provide an inverter circuit for a cold cathode fluorescent lamp that minimizes energy loss.

It is also desirable to provide a display assembly for a portable devices that is lightweight and compact.

SUMMARY OF THE INVENTION

In accordance with the present invention, there is provided a display assembly, an inverter circuit, and a method for driving both ends of a cold cathode fluorescent lamp in a floating configuration and to control the current through the lamp. At least one sense resistor is coupled between two secondary windings in a transformer. A rectifier is coupled to the secondary side of the transformer to generate a feedback signal to the control and drive circuit. A control and drive circuit receives the feedback signal and generates two different drive signals having approximately the same frequency and amplitude. One drive signal is applied to the first secondary winding and the other drive signal is applied to the second secondary winding. The drive signals are out of phase with one another.

In one embodiment, the first terminal of the first secondary transformer winding is coupled to one end of the fluorescent lamp, a second terminal of the second secondary transformer winding is coupled to another end of the fluorescent lamp, and a first sense resistor is coupled between the first secondary transformer winding and the second secondary transformer winding. A rectifier is coupled to the secondary side of the transformer to receive a signal indicative of the current at one or both ends of the fluorescent lamp. Any type of rectifier may be incorporated in the present invention including a full-wave rectifier, a synchronously switched rectifier, and a half-wave rectifier.

In an embodiment including a full wave rectifier, the inverter circuit includes a second sense resistor coupled between one terminal of the first sense resistor and another terminal of the second secondary transformer winding. The anode of a first diode is coupled between the first sense resistor and the first secondary transformer winding. The anode of a second diode is coupled between the second sense resistor and the second secondary transformer winding. One terminal of a ground reference resistor is coupled to ground between the first sense resistor and the second sense resistor, and the other terminal of the ground reference resistor coupled to the cathode of the first diode and the cathode of the second diode in series with the first diode and the second diode.

In an embodiment including a synchronously switched rectifier, a second sense resistor is coupled between one terminal of the first sense resistor and another terminal of the second secondary transformer winding. One terminal of a first switch is coupled between the first sense resistor and the first secondary transformer winding. One terminal of a second switch is coupled between the second sense resistor and the second secondary transformer winding. One terminal of a ground reference resistor is coupled to ground between the first sense resistor and the second sense resistor. The other terminal of the ground reference resistor coupled to another terminal of the first switch and another terminal of the second switch.

In an embodiment including a half-wave rectifier, the anode of a first diode is coupled between the first sense resistor and the first secondary transformer winding. One terminal of a ground reference resistor is coupled to ground between the first sense resistor and the second secondary transformer winding. The other terminal of the ground reference resistor is coupled to the cathode of the first diode in series with the first diode. The anode of a second diode is coupled to the one terminal of the second sense resistor, and the cathode of the second diode is coupled to the anode of the first diode.

The foregoing has outlined rather broadly the objects, features, and technical advantages of the present invention so that the detailed description of the invention that follows may be better understood.

BRIEF DESCRIPTION OF THE DRAWINGS

The present invention may be better understood, and its numerous objects, features, and advantages made apparent to those skilled in the art by referencing the accompanying drawings.

The use of the same reference symbols in different drawings indicates similar or identical items.

DETAILED DESCRIPTION

The present invention is described herein as being applied to a laptop computer display screens, many of which are back-lighted by one or more cold cathode fluorescent lamps (CCFLs). It is recognized, however, that the present invention may be utilized in any application requiring a control and drive circuit for a CCFL.

Figure 1:
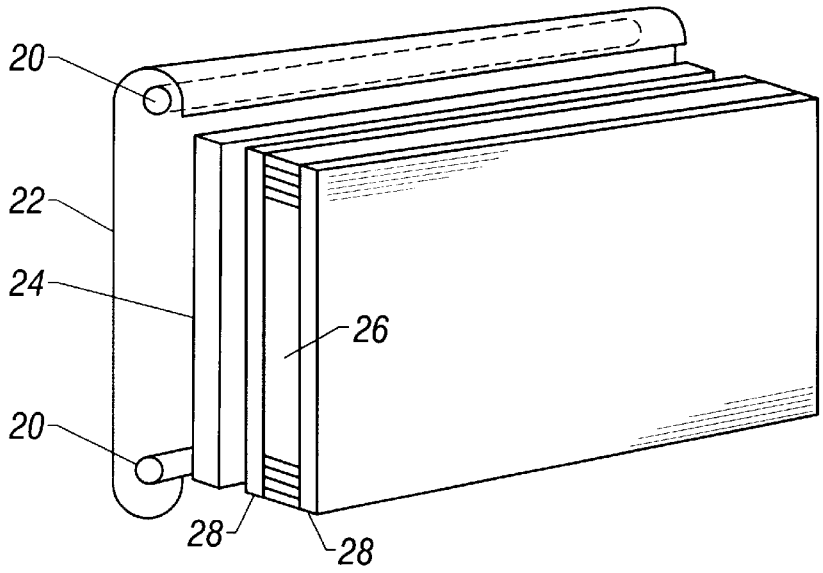
FIG. 1 (Prior Art)
FIG. 1 is a perspective view of a diagram of a typical configuration of components in a liquid crystal display assembly utilizing cold cathode fluorescent lamps for back-lighting.
Figure 1A:
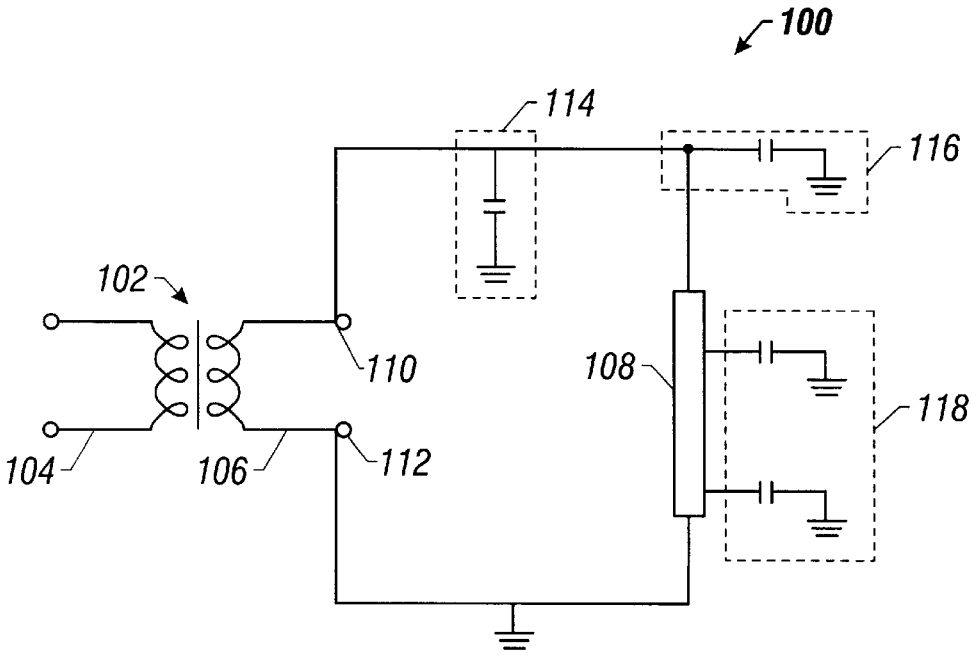
FIG. 1A (Prior Art)
FIG. 1A is a schematic diagram of a prior art inverter circuit.

One type of computer display assembly that utilizes CCFLs is a liquid crystal display (LCD). FIG. 1 shows a schematic drawing showing major components in a LCD assembly including two CCFLs 20, light reflector 22, light diffusion plate 24, liquid crystal 26, and polarizing plates 28. FIG. 1*a* shows a typical prior art inverter circuit 100 used to supply power to CCFLs 20 including transformer 102 having primary winding 104 and secondary winding 106. A first end of fluorescent lamp 108 is coupled to terminal 110 of secondary winding 106. The second end of lamp 108 is coupled to secondary winding 106 via terminal 112, which is also coupled to ground. Inverter circuit 100 excites lamp 108 by applying a high-voltage AC waveform to one end of the lamp (from terminal 110) while the other end is held at zero volts (i.e., ground).

Also shown in FIG. 1*a* are several capacitors 114, 116, 118 coupled to ground, representing parasitic capacitance. Each of the capacitors 114, 116, 118 is shown in a dashed box to indicate that the capacitor is not an actual capacitor, but is instead a representation of the parasitic loss of energy due to the various parasitic paths. For example, parasitic losses 114, 116 represent energy lost in the wire that connects secondary winding 106 to the first end of lamp 108, while parasitic losses 118 represent the energy lost in the lamp itself. Another source of parasitic capacitance is due to electrical interference with light reflector 22, which is typically constructed of metallic materials. It is well known that the energy lost via parasitic paths is equal to:

$$E=\tfrac{1}{2}(CV^2)$$

where C is the parasitic capacitance and V is the applied voltage. Inverter circuit 100 provides very accurate feedback control, however, significant power loss occurs due to the relatively high electric field at the non-grounded end. The electrical field potential near the grounded end of lamp 108 is comparatively small with low energy loss. Incremental energy losses accumulate over the length of the lamp starting at the grounded end, reaching a maximum value at the non-grounded end.

Figure 2A:
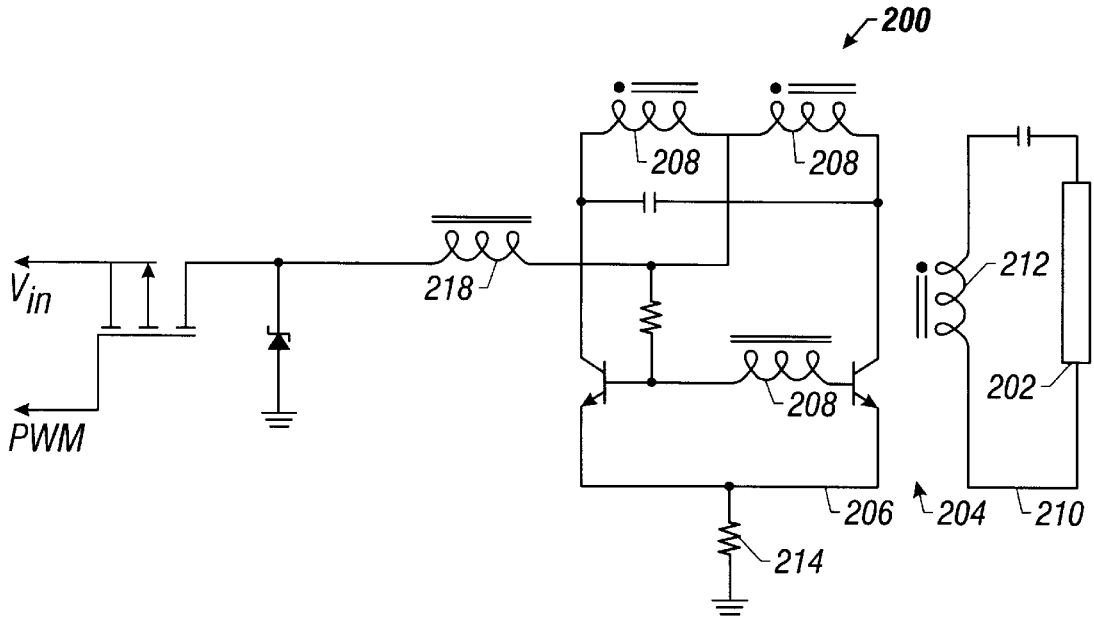
FIG. 2A (Prior Art)
FIG. 2A is a schematic diagram of a prior art inverter circuit utilizing a sense resistor in the primary side of a transformer for measuring current in the lamp.
Figure 2B:
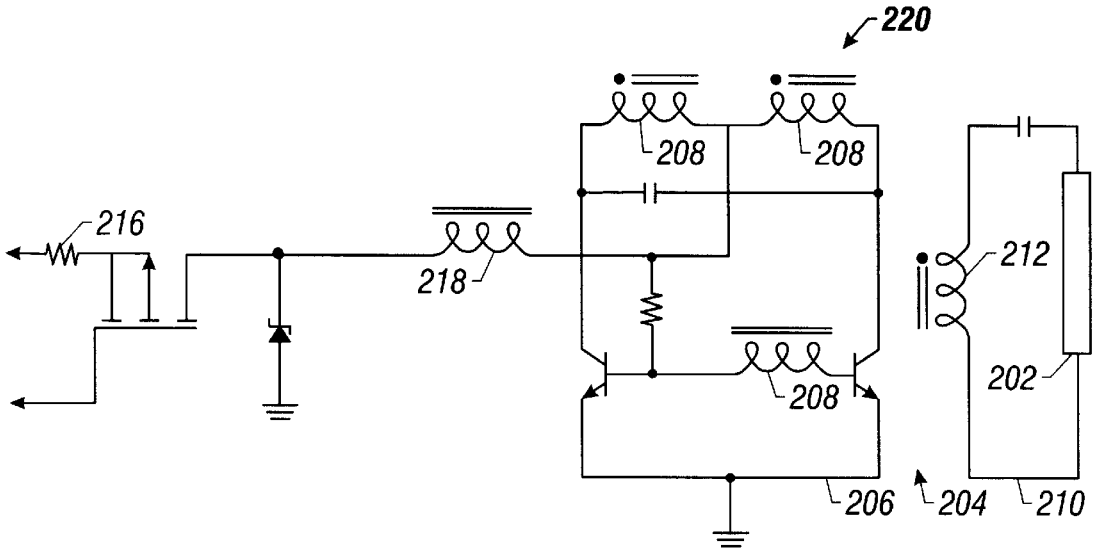
FIG. 2B (Prior Art)
FIG. 2B is a schematic diagram of another prior art inverter circuit utilizing a sense resistor in the primary side of a transformer for measuring current in the lamp.

The energy losses can be overcome by supplying energy to both ends of lamp 108, also referred to as driving lamp 108 in a floating configuration. The result is that total electrical potential, or voltage, is divided by a factor of two relative to each end of the lamp. The net energy loss due to parasitic capacitance is therefore reduced by over fifty percent since energy E is proportional to the squared value of voltage V. FIGS. 2*a* and 2*b* show known differential CCFL inverter circuits 200, 220 that reduce parasitic energy losses. Inverter circuit 200 in FIG. 2*a* is substantially similar to inverter circuit 220 in FIG. 2*b* in that both ends of lamp 202 are driven simultaneously. Transformer 204, which includes a primary side 206 having primary winding 208, and secondary side 210 having secondary winding 212, is coupled to lamp 202. Secondary winding 212 is not coupled to ground and is referred to as "floating".

Inverter circuits 200, 220 operate by driving both ends of lamp 202 with the same high voltage AC waveform, but the two ends are driven out of phase from each other. In this manner, lamp 202 is exposed to the same net high voltage amplitude swing, but the drive waveforms are approximately one-half the amplitude of the single-ended waveform required in inverter circuit 100. The reduced amplitude of the drive signals causes a reduction in the energy lost via parasitic paths.

If lamp 202 receives too much current, its service life will be reduced. If lamp 202 receives too little current, it may not provide the desired amount of illumination to satisfy the consumer. It is therefore important to be able to control the amount of current being delivered to lamp 202 to a desired value. One deficiency of prior art inverter circuits 200 and 220, however, is the difficulty in obtaining accurate feedback signals to control the current in secondary winding 212. This is because lamp 202 is driven by a high voltage current source and placing conventional current sense devices, such as a transformer, a hall effect device, or sense resistors, in the secondary side 210 of transformer 204 results in increased cost, size, and expense, and unacceptably large energy losses.

One alternative for measuring current is to place a current sense resistor in the primary winding 206 circuit, such as sense resistors 214, 216 shown in FIGS. 2*a* and 2*b*, respectively. While the lamp current is indeed reflected in primary winding 206, sense resistors 214, 216 are also subject to magnetizing current in transformer 204. It is therefore necessary to remove the magnetizing current component from the signal measured in sense resistors 214, 216 in order to use it as a feedback signal for controlling the lamp current. Magnetizing current $I_m$ is calculated using the following relationship:

$$I_m=(V_{in}/L_{pri})*T_{on}$$

Where:

$I_m$=magnetizing current $V_{in}$=voltage applied to the transformer winding $L_{pri}$=primary inductance of the transformer $T_{on}$=time input voltage is applied There are problems with accurately determining the magnetizing current, however, due to several variable factors. First, the value of the magnetizing current is proportional to the applied input voltage $V_{in}$. This parameter changes as the lamp current changes. Second, the magnetizing current is also proportional to the transformer inductance $L_{pri}$ in inductor 218. The value of $L_{pri}$ can vary up to ten percent in production. Third, the turn ratio between the primary winding 206 and the secondary winding 212 can be very high, for example, 140 to 1. Thus, any current measurement error on the primary side 206 will produce a current error on the secondary side 210 multiplied by the turn ratio. As a result, a CCFL having a maximum lamp current rating of approximately 5 to 6 milliamps, the above-mentioned variables can result in current errors in the range of 2 milliamps, which is equivalent to approximately 40 percent of the lamp's current rating. This amount of current error is unacceptably large, and underscores the importance of providing feedback to control the current to lamp 202.

Another problem with measuring current on the primary side 206 is the loss of energy and reduced efficiency of inverter circuits 200 and 220 due to the fact that sense resistors 214, 216 must have a relatively high value of resistance to provide accurate measurements and to achieve a desirable signal to noise ratio. The voltage loss due to high values of current and resistance in sense resistors 214, 216 lowers the amount of energy available in the battery for operating the device, such as a laptop computer.

Even if magnetizing current $I_m$ can be determined within acceptable accuracy in inverter circuits 200 and 220, there is no reference for the floating load to ground. Therefore, if there are any parasitic imbalances on either side of lamp 202, the respective side may establish itself at a virtual ground, thereby negating the benefits of a floating lamp configuration.

Figure 3:
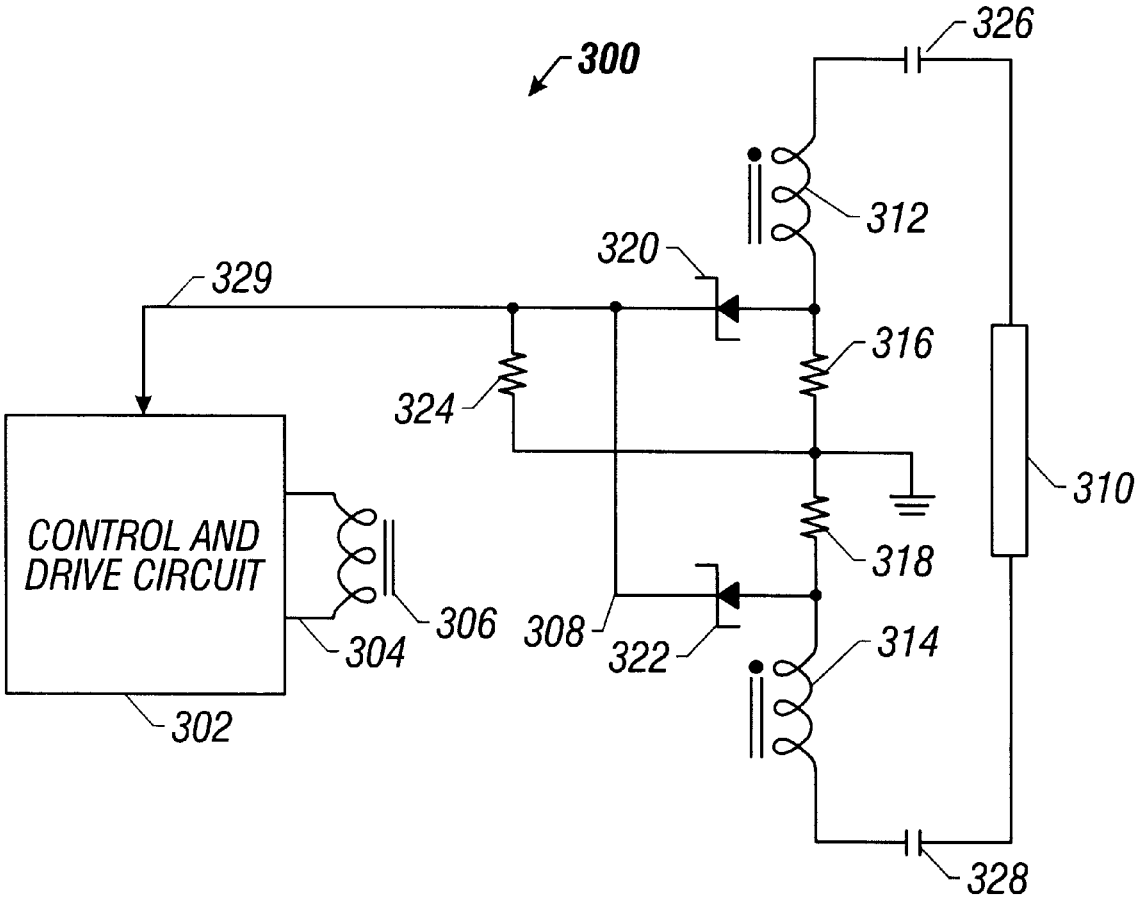
FIG. 3 is a schematic diagram of an embodiment of an inverter circuit according to the present invention utilizing dual secondary windings, dual diodes for full wave rectification, and dual sense resistors for providing a feedback signal to a control and drive circuit.

The deficiencies of known floating lamp inverter circuits are overcome by an embodiment of the present invention for a floating lamp inverter circuit 300 shown in FIG. 3. Inverter circuit 300 includes control and drive circuit 302 coupled to primary winding 304 of transformer 306. Secondary side 308 of transformer 306 is coupled to lamp 310 and includes secondary windings 312,314, sense resistors 316, 318, diodes 320, 322, resistor 324, and capacitors 326, 328. Secondary windings 312, 314 are coupled to lamp 310 such that secondary winding 312 has one terminal 330 coupled to one end of lamp 310 and secondary winding 314 has one terminal 332 couple to the other end of lamp 310. Secondary side 308 of transformer 306 is also coupled to provide directly sensed feedback signal 329 to control and drive circuit 302. Capacitors 326, 328 are coupled to either end of lamp 310 to balance the volts per turn of each secondary winding 312, 314.

Compared to prior art inverter circuits, the present invention splits the once singular secondary winding 212 to form two secondary windings 312, 314, coupled as shown in FIG. 3 to provide substantially equal energy to both ends of lamp 310. Secondary windings 312 and 314 are separated by sense resistors 316 and 318. The connection between sense resistors 316 and 318 is tied to ground to establish a reference for the outside end of each secondary winding 312, 314. This reference ensures that the peak voltage at each secondary winding 312, 314 is balanced and has equal voltage potential relative to ground. Split secondary windings 312, 314 overcome the deficiencies of prior art inverter circuits by balancing the voltage potential at each end of lamp 310 and providing feedback signal 329 to control and drive circuit 302 for controlling the current through lamp 310 at a desired value. Control and drive circuit 302 may be implemented with electronic circuitry or a microcontroller utilizing a combination of hardware, software, and/or firmware.

Figure 3A:
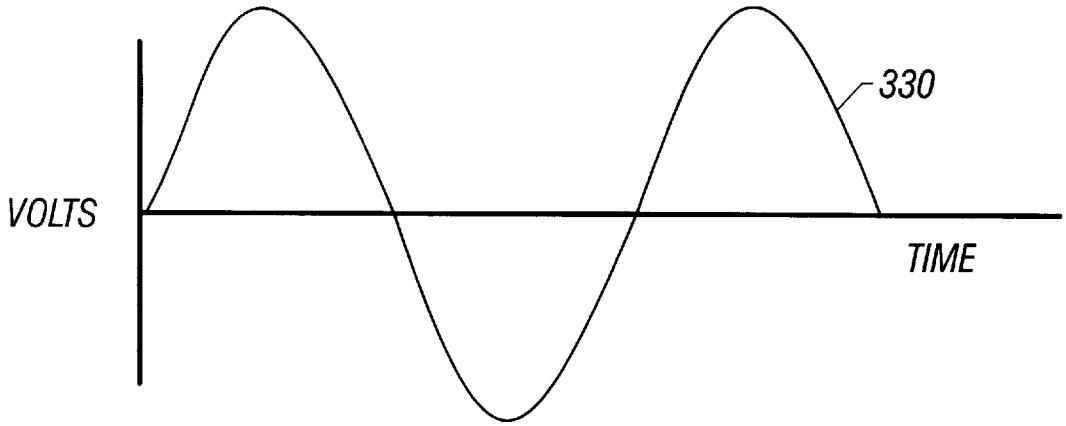
FIG. 3A is a time history diagram of a drive waveform across one sense resistor in FIG. 3.
Figure 3B:
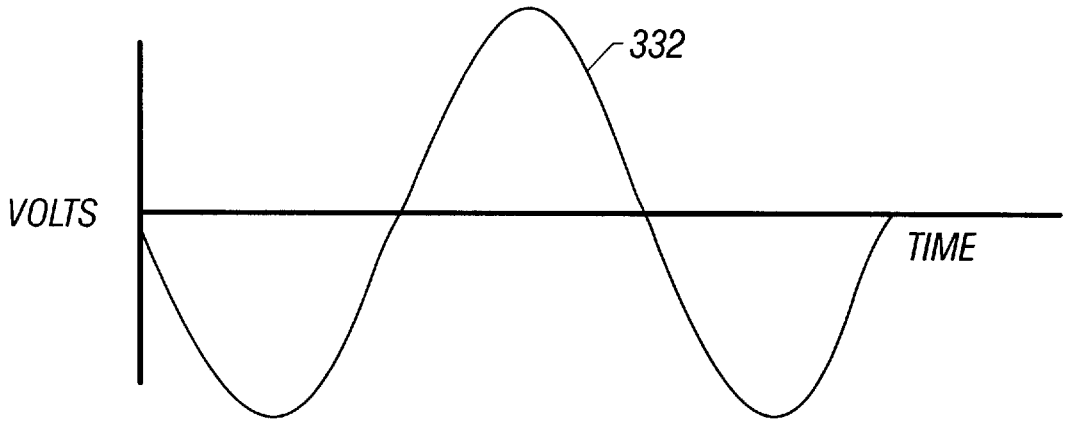
FIG. 3B is a time history diagram of a drive waveform across another sense resistor in FIG. 3.
Figure 3C:
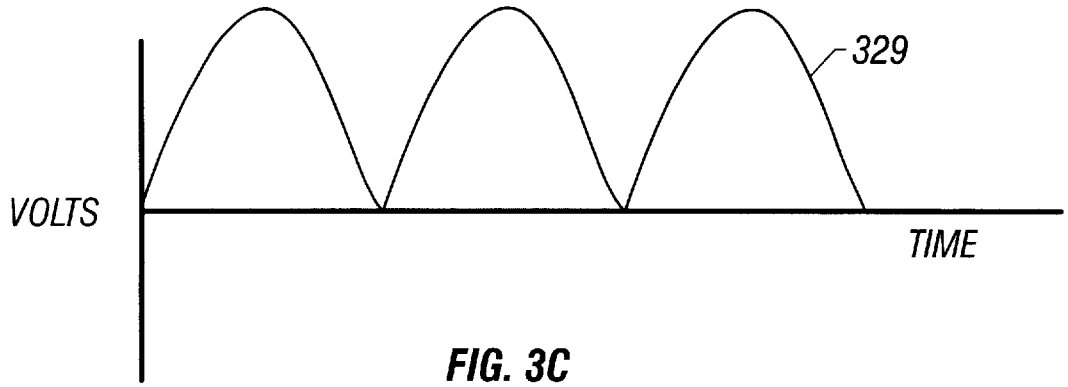
FIG. 3C is a time history diagram of the feedback signal to control and drive circuit in FIG. 3.

Secondary windings 312, 314 drive both ends of lamp 310 with the same high voltage AC waveform, but the two ends are driven out of phase from each other. FIG. 3*a* shows an example of a time history diagram of drive waveform 330 across secondary winding 312 and sense resistor 316, and FIG. 3*b* shows an example of a time history of drive waveform 332 across secondary winding 314 and sense resistor 318. Drive waveforms 330, 332 expose lamp 310 to the same net high voltage amplitude swing, but the drive waveforms are approximately one-half the amplitude of the single-ended waveform required in inverter circuit 100. Since energy loss is proportional to the squared value of the amplitude of the voltage, the reduced voltage amplitude of the drive signals causes an exponential reduction in the energy lost via parasitic paths. Feedback signal 329 includes one component from the combination of diode 320 and resistor 324, which acts as a half-wave rectifier for drive waveform 330, allowing only the positive portions of drive waveform 330 to be fed back to control and drive circuit 302. Diode 322 and resistor 324 act as a half-wave rectifier for drive waveform 332, resulting in the positive portions of drive waveform 332 being fed back to control and drive circuit 302, and thus forming another component of feedback signal 329. FIG. 3*c* shows the feedback signal 329 sensed by sense resistors 316 and 318.

Figure 4:
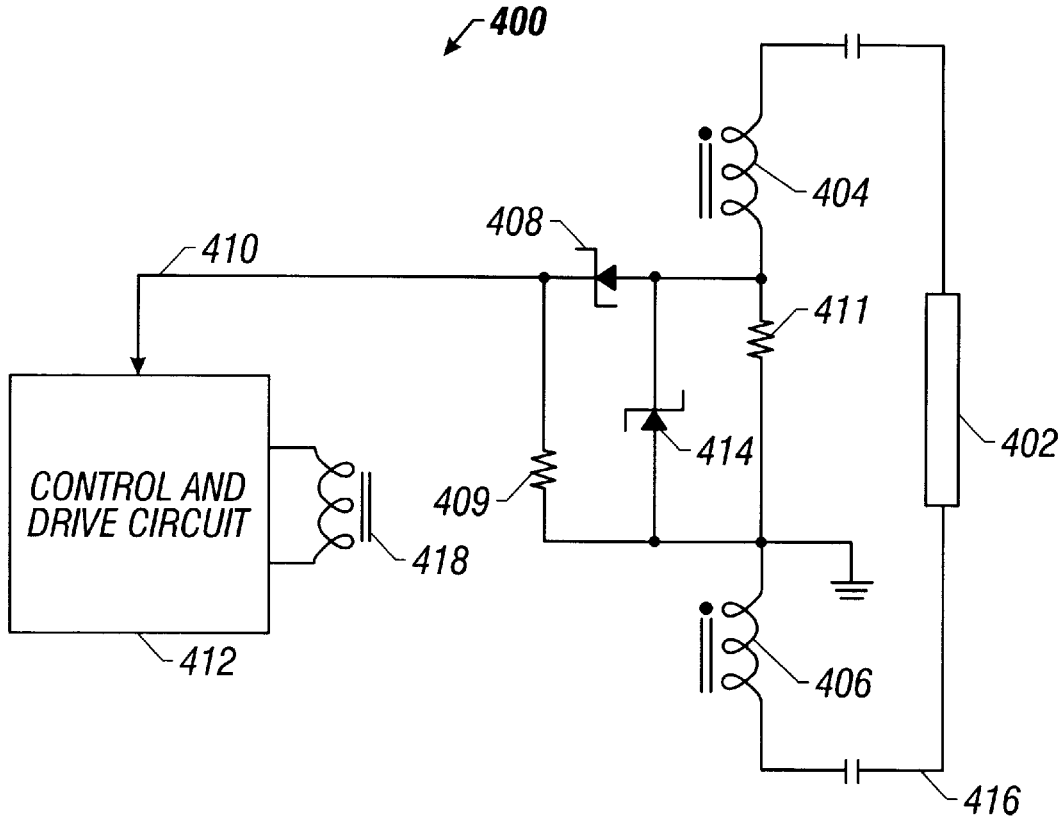
FIG. 4 is a schematic diagram of another embodiment of an inverter circuit according to the present invention utilizing dual secondary windings, one diode for half-wave rectification, and a single sense resistor for providing a feedback signal to a control and drive circuit.

The present invention may be incorporated in various configurations of inverter circuits including full wave rectifiers, as discussed with respect to FIG. 3 hereinabove, as well as half-wave and synchronously switched rectifiers. An embodiment of the present invention incorporating a half-wave rectifier is shown as inverter circuit 400 in FIG. 4. Inverter circuit 400 is somewhat similar to inverter circuit 300 described above with respect to FIG. 3 in that inverter circuit 400 provides drive signals that are out of phase with one another, such as drive waveforms 330, 332, to both ends of lamp 402 through dual secondary windings 404, 406. Inverter circuit 400 includes diode 408, which in combination with resistor 409, provides a half-wave rectifier for generating feedback signal 410 to control and drive circuit 412. Control and drive circuit 412 may be implemented with electronic circuitry or a microcontroller utilizing a combination of hardware, software, and/or firmware.

Only one sense resistor 411 is required in inverter circuit 400 since the feedback signal 410 includes feedback from only one secondary winding. Note that diodes 408 and 414 may be coupled to provide feedback from either secondary winding 404 or 406. One end of resistor 409 is tied to ground to provide a reference for diodes 408 and 414. Diode 414 prevents a voltage drop across resistor 409 by blocking current during one half of the drive waveform cycle. Diode 414 may be eliminated, however, the energy efficiency of inverter circuit 400 will decrease correspondingly.

Figure 4A:
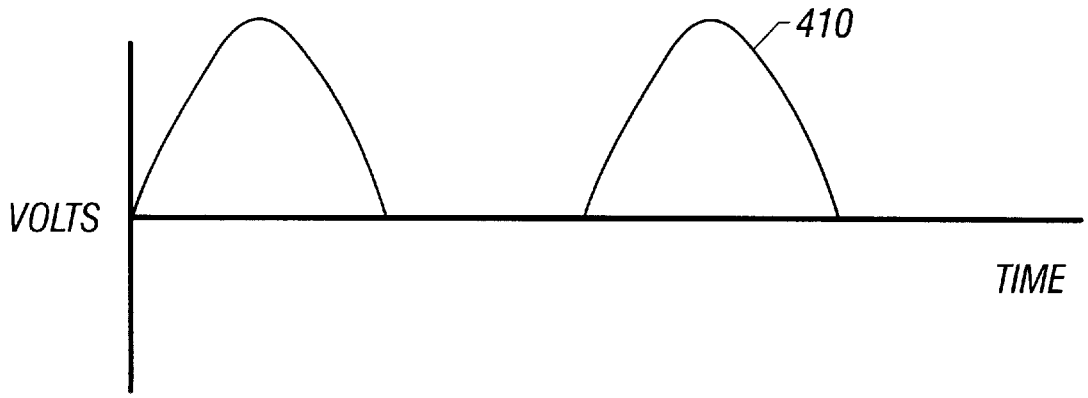
FIG. 4A is a time history diagram of the feedback signal to the control and drive circuit in FIG. 4.

The feedback signal 410 generated by the half-wave rectifier includes only the positive portion of the drive waveform, such as shown in FIG. 4a when drive waveform 330 (FIG. 3*a*) is applied to secondary winding 404. Inverter circuit 400 is also similar to inverter circuit 300 in that drive waveforms expose the lamp to the same net high voltage amplitude swing, but the drive waveforms are approximately one-half the amplitude that would be required in inverter circuit 100. Once again, energy loss is proportional to the squared value of the amplitude of the voltage, therefore, the reduced voltage amplitude of the drive signals causes a correspondingly exponential reduction in the energy lost via parasitic paths.

Figure 5:
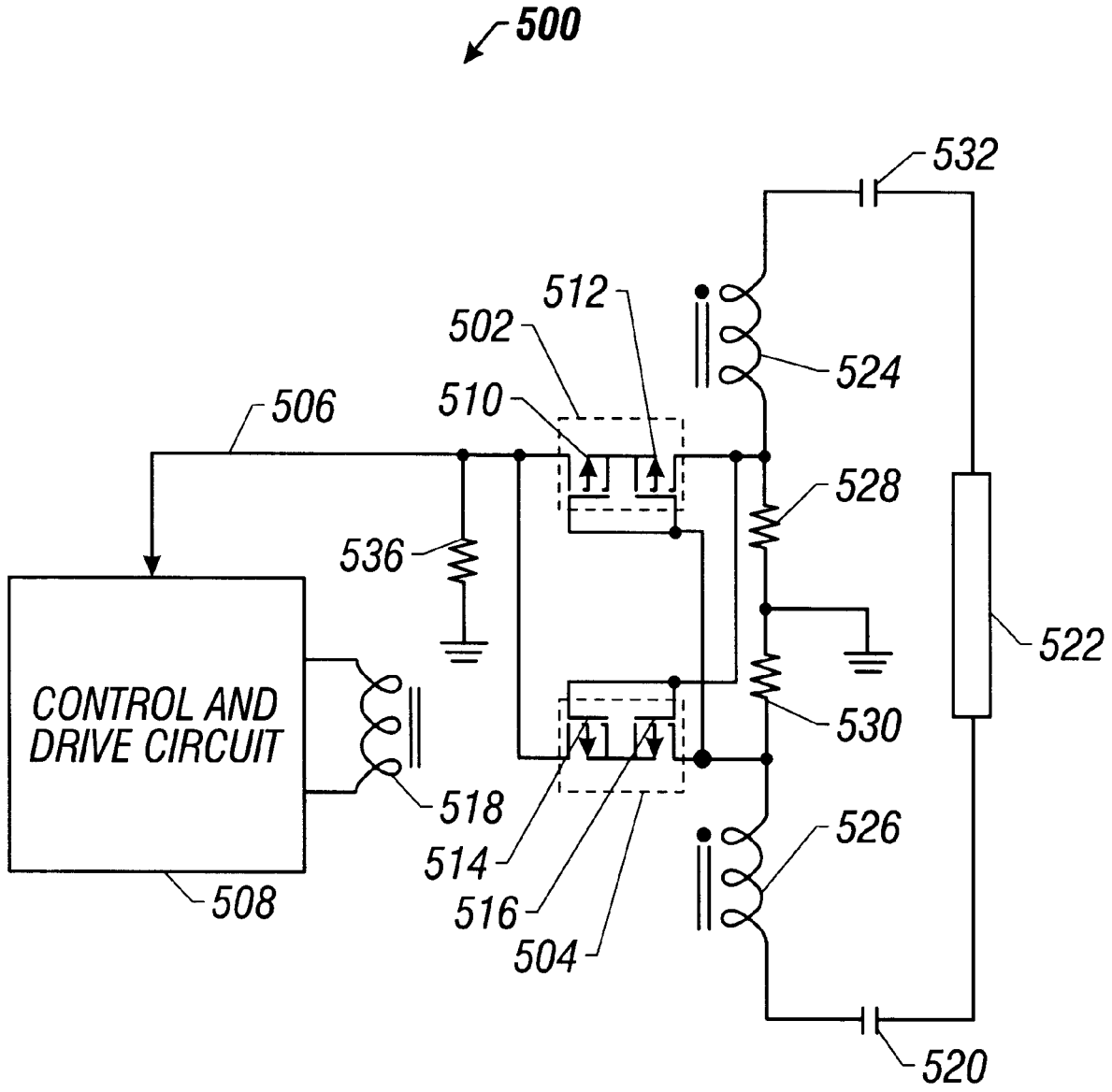
FIG. 5 is a schematic diagram of another embodiment of an inverter circuit according to the present invention utilizing dual secondary windings, four field effect transistors for synchronous full-wave rectification, and dual sense resistors for providing feedback signal to a current control circuit.

A further embodiment of the present invention is shown as inverter circuit 500 in FIG. 5, which includes a pair of synchronously switched switches 502, 504.

Inverter circuit 500 provides feedback signal 506 to control and drive circuit 508 that has very low distortion when power transistors, such as field effect transistors 510, 512, 514, and 516 are utilized due to the very low energy dissipation in these types of transistors. Inverter circuit 500 is similar to inverter circuit 300 described above with respect to FIG. 3 in that inverter circuit 500 includes control and inverter circuit 508 coupled to primary winding 518. Secondary side 520 of inverter circuit 500 is coupled to lamp 522 and includes secondary windings 524 and 526, sense resistors 528 and 530, and capacitors 532 and 534. Secondary windings 524 and 526 provide substantially equal energy to both ends of lamp 522.

Secondary windings 524 and 526 are separated by sense resistors 528 and 530. The connection between sense resistors 528 and 530 is tied to ground to establish a reference for the outside end of each secondary winding 524, 526. This reference ensures that the peak voltage at each secondary winding 524, 526 is balanced and has equal voltage potential relative to ground. As with the other embodiments of inverter circuits 300 and 400 discussed herein, split secondary windings 524, 526 and sense resistors 528 and 530 overcome the deficiencies of prior art inverter circuits by substantially balancing the voltage potential at each end of lamp 522 and providing a direct feedback signal 506 to control and drive circuit 508 for controlling the current through lamp 522. Control and drive circuit 508 may be implemented with electronic circuitry or a microcontroller utilizing a combination of hardware, software, and/or firmware.

Secondary windings 524, 526 drive both ends of lamp 522 with the same high voltage AC waveform, such as drive waveforms 330 and 332 as discussed hereinabove where the two ends of lamp 522 are driven out of phase from each other with approximately one-half the amplitude of the single-ended waveform required in inverter circuit 100, thereby greatly reducing the energy lost via parasitic paths. The combination of switch 502 and resistor 536 acts as a half-wave rectifier for a first drive waveform, allowing only the positive portions of the drive waveform to be fed back to control and drive circuit 508. Switch 504 and resistor 536 act as a half-wave rectifier for a second drive waveform that is out of phase with the first drive waveform, resulting in the positive portions of the second drive waveform being fed back to control and drive circuit 514. For example, when drive waveforms such as drive waveforms 330 and 332 in FIGS. 3*a* and 3*b* are input to drive inverter circuit 500, feedback signal 506 has a shape similar to feedback signal 329 in FIG. 3*c*. The difference between the embodiments of the present invention in FIGS. 3 and 5 is that inverter circuit 500 provides feedback signal 506 having less distortion than feedback signal 329 in inverter circuit 300.

The present invention provides advantages when utilized in applications having one or more CCFLs such as laptop computers and other battery operated portable devices where low energy consumption and space saving are important considerations. The split secondary winding configuration accommodates a wide range of drive waveforms including sinusoidal, sawtooth, and step waveforms, depending on the requirements of the particular device. A further advantage of the present invention is that current is measured directly on the secondary side of the transformer, thereby eliminating measurement error due to magnetizing current.

Further, typical prior art inverter control loops utilize feedback from only one half cycle of a drive waveform, thereby introducing prediction errors due to asymmetry of the drive signal. The present invention generates a feedback signal over the full cycle of the drive waveforms, thus providing a feedback signal that is based on the actual current at both ends of the CCFL. This accurate feedback signal allows the control and drive circuit to balance the output voltage to the lamp, thereby minimizing parasitic capacitance. The energy saving due to halving the voltage amplitude allows switching frequency to double, yielding a smaller inductor. The present invention thus provides inverter circuits for illuminating fluorescent lamps that save energy, space, and weight compared to known inverter circuits.

While the invention has been described with respect to the embodiments and variations set forth above, these embodiments and variations are illustrative and the invention is not to be considered limited in scope to these embodiments and variations. Accordingly, various other embodiments and modifications and improvements not described herein may be within the spirit and scope of the present invention, as defined by the following claims.

What is claimed is:

1. A computer system comprising:

a display assembly including a cold cathode fluorescent lamp;

an inverter circuit coupled to the cold cathode fluorescent lamp including:

a primary transformer winding;

a first secondary transformer winding having a first terminal coupled to one end of the cold cathode fluorescent lamp;

a second secondary transformer winding having a first terminal coupled to another end of the cold cathode fluorescent lamp;

a first sense resistor coupled between the first secondary transformer winding and the second secondary transformer winding; and a rectifier coupled to receive a signal indicative of the current at an end of the cold cathode fluorescent lamp.

2. The computer system, as set forth in claim 1, wherein the rectifier is a full wave rectifier.

3. The computer system, as set forth in claim 2, further comprising a second sense resistor coupled between one terminal of the first sense resistor and another terminal of the second secondary transformer winding, the full wave rectifier including:

a first diode having an anode coupled between the first sense resistor and the first secondary transformer winding;

a second diode having an anode coupled between the second sense resistor and the second secondary transformer winding; and a ground reference resistor having one terminal coupled to ground between the first sense resistor and the second sense resistor, the other terminal of the ground reference resistor coupled to the cathode of the first diode and the cathode of the second diode in series with the first diode and the second diode.

4. The computer system, as set forth in claim 1, wherein the rectifier is a synchronously switched rectifier.

5. The computer system, as set forth in claim 4, further comprising a second sense resistor coupled between one terminal of the first sense resistor and another terminal of the second secondary transformer winding, the synchronously switched rectifier including:

a first switch having one terminal coupled between the first sense resistor and the first secondary transformer winding;

a second switch having one terminal coupled between the second sense resistor and the second secondary transformer winding; and a ground reference resistor having one terminal coupled to ground between the first sense resistor and the second sense resistor, the other terminal of the ground reference resistor coupled to another terminal of the first switch and another terminal of the second switch.

6. The computer system, as set forth in claim 1, wherein the rectifier is a half wave rectifier.

7. The computer system, as set forth in claim 6, wherein the half wave rectifier includes:

a first diode having an anode coupled between the first sense resistor and the first secondary transformer winding;

a ground reference resistor having one terminal coupled to ground between the first sense resistor and the second secondary transformer winding, the other terminal of the ground reference resistor coupled to the cathode of the first diode in series with the first diode; and a second diode having an anode coupled the one terminal of the second sense resistor, the second diode having a cathode coupled to the anode of the first diode.

8. The computer system, as set forth in claim 1, wherein the rectifier is operable to generate a signal indicative of the current at one end of the cold cathode fluorescent lamp.

9. The computer system, as set forth in claim 8, further comprising:

a control and drive circuit coupled to receive the signal indicative of the current at one end of the cold cathode fluorescent lamp, the control and drive circuit being further coupled to the primary transformer winding, the control and drive circuit being operable to generate a drive signal, the primary transformer being operable to receive the drive signal from the control and drive circuit.

10. An inverter circuit for providing a drive signal to operate a fluorescent lamp, the inverter circuit comprising:

a primary transformer winding;

a first secondary transformer winding having a first terminal coupled to one end of the fluorescent lamp;

a second secondary transformer winding having a first terminal coupled to another end of the fluorescent lamp; and a first sense resistor coupled between the first secondary transformer winding and the second secondary transformer winding.

11. The inverter circuit, as set forth in claim 10, further comprising a rectifier coupled to receive a signal indicative of the current at an end of the fluorescent lamp.

12. The inverter circuit, as set forth in claim 11, further comprising a second sense resistor coupled between one terminal of the first sense resistor and another terminal of the second secondary transformer winding, the full wave rectifier including:

a first diode having an anode coupled between the first sense resistor and the first secondary transformer winding;

a second diode having an anode coupled between the second sense resistor and the second secondary transformer winding; and a ground reference resistor having one terminal coupled to ground between the first sense resistor and the second sense resistor, the other terminal of the ground reference resistor coupled to the cathode of the first diode and the cathode of the second diode in series with the first diode and the second diode.

13. The inverter circuit, as set forth in claim 11, further comprising a second sense resistor coupled between one terminal of the first sense resistor and another terminal of the second secondary transformer winding, the synchronously switched rectifier including:

a first switch having one terminal coupled between the first sense resistor and the first secondary transformer winding;

a second switch having one terminal coupled between the second sense resistor and the second secondary transformer winding; and a ground reference resistor having one terminal coupled to ground between the first sense resistor and the second sense resistor, the other terminal of the ground reference resistor coupled to another terminal of the first switch and another terminal of the second switch.

14. The inverter circuit, as set forth in claim 11, wherein the half wave rectifier includes:

a first diode having an anode coupled between the first sense resistor and the first secondary transformer winding;

a ground reference resistor having one terminal coupled to ground between the first sense resistor and the second secondary transformer winding, the other terminal of the ground reference resistor coupled to the cathode of the first diode in series with the first diode; and a second diode having an anode coupled the one terminal of the second sense resistor, the second diode having a cathode coupled to the anode of the first diode.

15. The inverter circuit, as set forth in claim 11, wherein the rectifier is operable to generate a signal indicative of the current at one end of the fluorescent lamp.

16. The inverter circuit, as set forth in claim 15, further comprising:

a control and drive circuit coupled to receive the signal indicative of the current at one end of the fluorescent lamp, the control and drive circuit being further coupled to the primary transformer winding, the control and drive circuit being operable to generate a drive signal, the primary transformer being operable to receive the drive signal from the control and drive circuit.

17. A method for illuminating a fluorescent lamp with a control and drive circuit coupled to a transformer having a primary side with a primary transformer winding , and a secondary side with a first secondary transformer winding and a second secondary transformer winding, the method comprising:

(a) coupling a first terminal of the first secondary transformer winding to one end of the fluorescent lamp;

(b) coupling a first terminal of the second secondary transformer winding to another end of the fluorescent lamp; and (c) coupling a first sense resistor between the first secondary transformer winding and the second secondary transformer winding;

(d) driving the first secondary transformer winding with a first AC drive signal;

(e) driving the second secondary transformer winding with a second AC drive signal that is out of phase with the first AC drive signal; and (f) generating a feedback signal indicative of current through at least one end of the fluorescent lamp.

18. The method, as set forth in claim 17, further comprising coupling a rectifier to the secondary side of the transformer to generate the feedback signal.

19. The method, as set forth in claim 18, further comprising:

coupling a second sense resistor between one terminal of the first sense resistor and another terminal of the second secondary transformer winding;

coupling the anode of a first diode between the first sense resistor and the first secondary transformer winding;

coupling the anode of a second diode between the second sense resistor and the second secondary transformer winding;

coupling one terminal of a ground reference resistor to ground between the first sense resistor and the second sense resistor; and coupling the other terminal of the ground reference resistor to the cathode of the first diode and to the cathode of the second diode such that the ground reference resistor is in series with the first diode and the second diode.

20. The method, as set forth in claim 17, further comprising:

coupling a second sense resistor between one terminal of the first sense resistor and another terminal of the second secondary transformer winding;

coupling one terminal of a first switch between the first sense resistor and the first secondary transformer winding;

coupling one terminal of a second switch between the second sense resistor and the second secondary transformer winding; and coupling one terminal of a ground reference resistor to ground between the first sense resistor and the second sense resistor; and coupling the other terminal of the ground reference resistor to another terminal of the first switch and another terminal of the second switch.

21. The method, as set forth in claim 17, further comprising:

coupling the anode of a first diode between the first sense resistor and the first secondary transformer winding;

coupling one terminal of a ground reference resistor to ground between the first sense resistor and the second secondary transformer winding;

coupling the other terminal of the ground reference resistor to the cathode of the first diode in series with the first diode;

coupling the anode of a second diode to the one terminal of the second sense resistor; and coupling the cathode of the second diode to the anode of the first diode.

22. The method, as set forth in claim 18, further comprising:

coupling a control and drive circuit to the rectifier to receive the feedback signal; and generating the first and second AC drive signals based on the feedback signal to control current through the fluorescent lamp.

* * * * *